US005302928A

United States Patent [19]

Laskaris et al.

[11] Patent Number: 5,302,928

[45] Date of Patent: Apr. 12, 1994

[54] SUPERCONDUCTING CURRENT LEADS FOR A CRYOGENLESS SUPERCONDUCTING MAGNETIC ENERGY STORAGE DEVICE

[75] Inventors: Evangelos T. Laskaris, Schenectady; Ahmed K. Kalafala, Albany, both of N.Y.

[73] Assignee: General Electric Company, Schenectady, N.Y.

[21] Appl. No.: 923,684

[22] Filed: Aug. 3, 1992

[51] Int. Cl.[5] ..... H01F 1/00

[52] U.S. Cl. ..... 335/216; 174/15.4

[58] Field of Search ..... 335/216, 301, 299; 174/15.4

[56] References Cited

U.S. PATENT DOCUMENTS

| | | | |
|---|---|---|---|
| 4,986,078 | 1/1991 | Laskaris | 335/216 |
| 5,018,359 | 5/1991 | Horikawa et al. | 335/216 |
| 5,083,105 | 1/1992 | Herd et al. | 335/216 |

*Primary Examiner*—Lincoln Donovan
*Attorney, Agent, or Firm*—Paul R. Webb, II

[57] ABSTRACT

This invention relates to current leads for a superconducting magnet system of the type that are constructed of two-stages. Such structures of this type, generally, operate from ambient temperature to the temperature at the thermal shield and from the temperature of the thermal shield to that of the magnet such that ohmic losses are reduced.

10 Claims, 3 Drawing Sheets

14
12
2
58
56
7
54
62
52
18
60
66
58
26
64
74
4
2
72
68
7
2
18

SUPERCONDUCTING CURRENT LEADS FOR A CRYOGENLESS SUPERCONDUCTING MAGNETIC ENERGY STORAGE DEVICE

BACKGROUND OF THE INVENTION

1. Field of the Invention

This invention relates to current leads for a superconducting magnet system of the type that are constructed of two-stages. Such structures of this type, generally, operate from ambient temperature to the temperature at the thermal shield and from the temperature of the thermal shield to that of the magnet such that ohmic losses are reduced.

2. Description of the Related Art

Today, low power electronic systems are being used increasingly as controllers for much larger mechanical-/electrical machinery. A wide variety of industries across the country are finding that these automated electronic equipment—including adjustable-speed drives, programmable logic controllers and power supplies in computers—are vulnerable to overvoltage, undervoltage, momentary interruptions and other disturbances that have always existed in the utility power line. Much of this advanced equipment also generates disturbances back onto the utility line. Therefore, a more advantageous system, then, would be presented if such amounts of these various electrical disturbances were reduced.

Also, it is known to employ the use of current leads in electrical equipment. However, the nature of these leads often results in high ohmic loses. These ohmic loses can adversely affect the performance characteristics of the electrical equipment. Therefore, a still further advantageous system would be presented if such amounts of these ohmic loses were reduced.

It is apparent from the above that there exists a need in the art for a current lead assembly which is capable of being utilized in a superconducting magnet, and which at least equals the performance characteristics of known superconducting lead assemblies, which at the same time is capable of reducing the ohmic loses. It is a purpose of this invention to fulfill this and other needs in the art in a more apparent to the skilled artisan once given the following disclosure.

SUMMARY OF THE INVENTION

Generally speaking, this invention fulfills these needs by providing a current lead assembly for a superconducting magnet, comprising a superconducting magnet having a thermal shield means and a heat station means, an ambient temperature interface means, a first stage current lead means operatively connected to said thermal shield means and said ambient temperature interface means, and a second stage current lead means operatively connected to said thermal shield means and said magnet.

In certain preferred embodiments, the first stage current lead means is constructed of copper. Also, the second stage current lead means is constructed of either copper or a high-temperature superconductor. Finally, the current leads are cooled by direct contact to the magnet and the shield heat stations.

In another further preferred embodiment, substantially all of the ohmic loses experienced by the magnet are reduced.

The preferred current lead assembly, according to this invention, offers the following advantages: ease of assembly; excellent heat conduction characteristics; good stability; good durability; reduced ohmic loses; good economy and high strength for safety. In fact, in many of the preferred embodiments these factors of heat conduction and reduced ohmic loses are optimized to an extent that it is considerably higher than heretofore achieved in prior, known current lead assemblies.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several veins and in which.

DETAILED DESCRIPTION OF THE INVENTION

Figure 1:
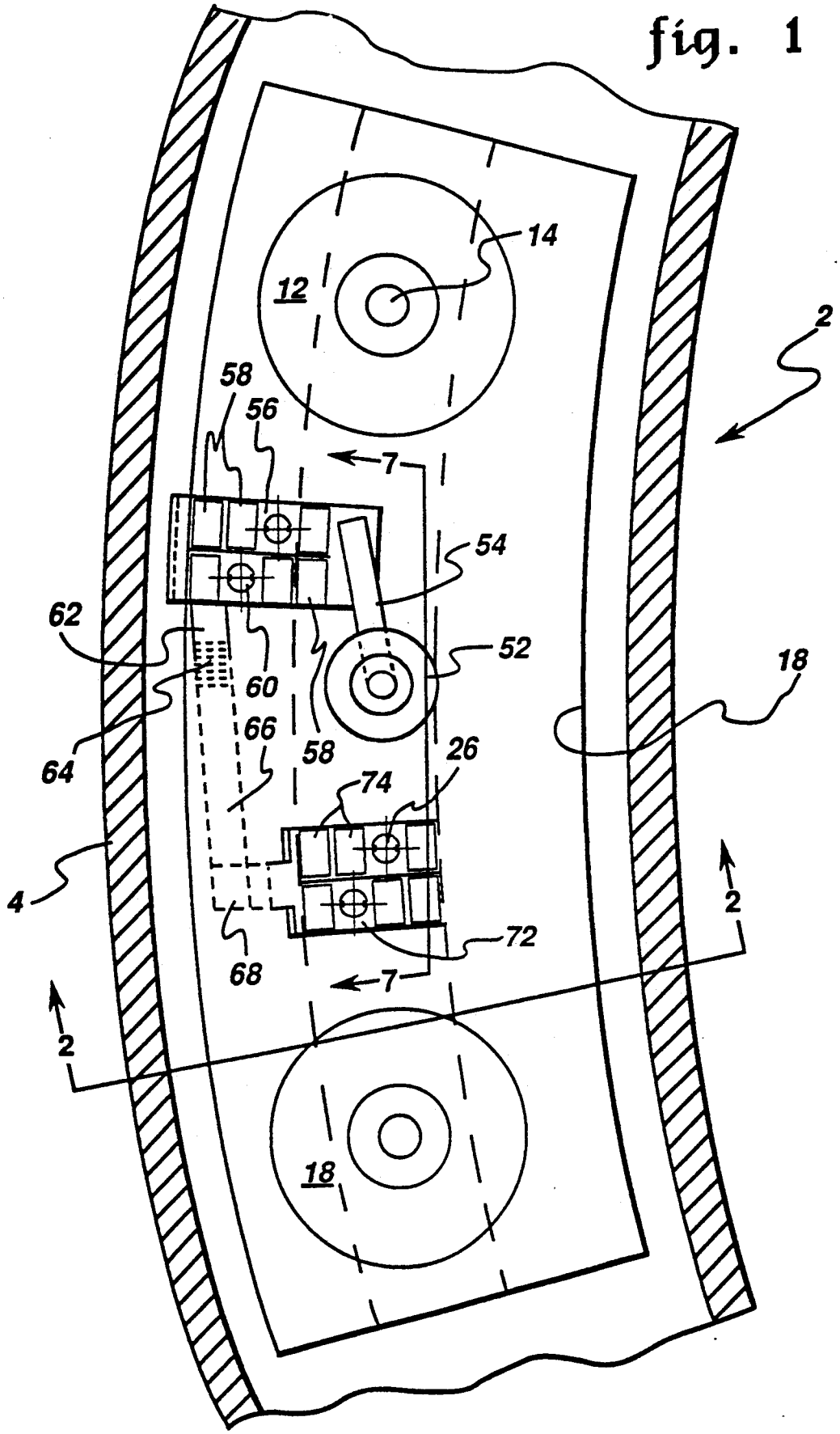
FIG. 1 is a top view of a current lead assembly for a superconducting magnet, according to the present invention.
Figure 2:
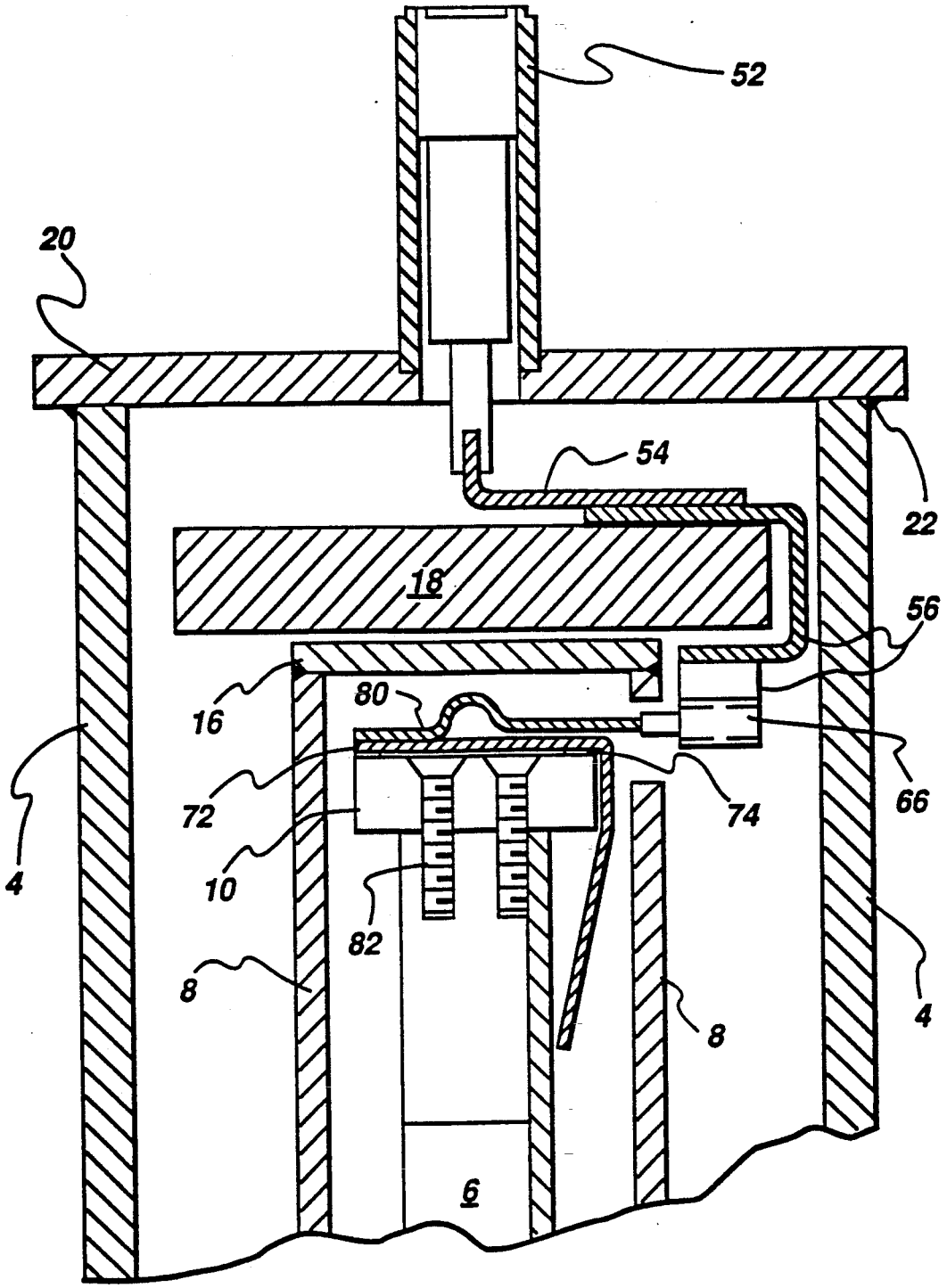
FIG. 2 is an end view of the superconducting lead assembly, taken along lines 2—2 of FIG. 1.

With reference first to FIG. 1, there is illustrated current lead assembly 2 for a superconducting magnet. In particular, lead assembly 2 includes, in part, a conventional current lead output port 52, first stage lead 54, lead extension 56, second stage lead 66 (FIG. 2), second stage contact 72, vacuum envelope 4, thermal shield 8 and heat station 18. In particular, as shown with respect to FIGS. 1 and 2, port 52 is rigidly attached to plate 20 by a conventional welding (not shown). Port 52 is thermally and electrically connected to first stage lead 54. Lead 54, preferably, is constructed of copper. Lead 54 is rigidly attached to thermal extension 56 by conventional soldered joint (not shown). Located between thermal station 18 and thermal extension 56 are thermal contacts 58. Thermal contacts 58, preferably are constructed of metallized beryllia or alumina ceramic. These thermal contacts 58 allow heat to transfer from thermal station 18 to lead 54, and at the same time provide electrical insulation to lead 54 with respect to thermal station 18.

Figure 3:
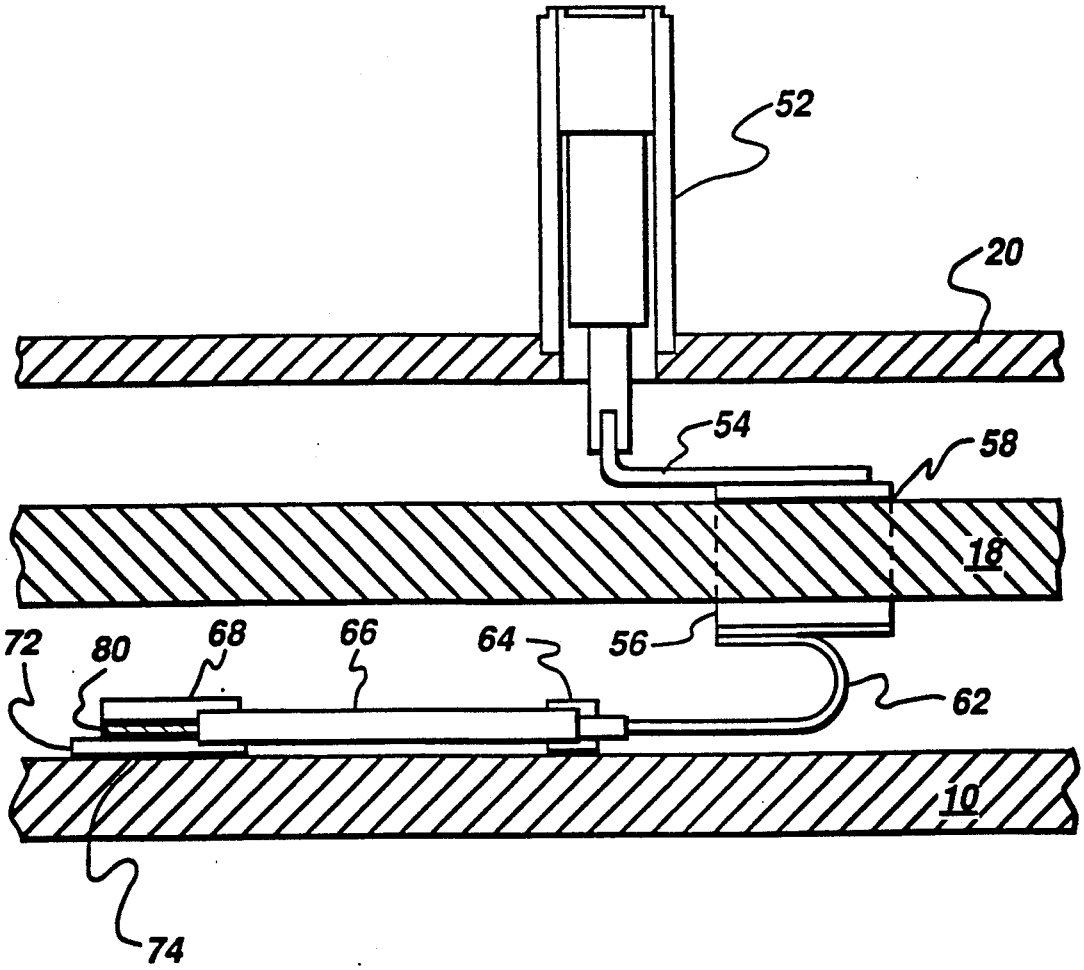
FIG. 3 is a side view of the superconducting lead assembly, taken along lines 3—3 of FIG. 1, according to the present invention.

Located below thermal extension 56 is thermal busbar 62 (FIG. 3). Busbar 62 is, preferably, constructed of a flexible copper laminate and is rigidly attached to thermal extension 56 by a conventional soldered joint (not shown). Also, busbar 62 is rigidly attached to superconducting lead extension 64 by a conventional soldered joint (not shown). A conventional superconducting lead 66 is rigidly attached to extension 64. Lead 66 is, preferably, constructed of any suitable high temperature ceramic superconducting material. The other end of lead 66 is rigidly attached to thermal extension 68 by a conventional soldered joint (not shown).

Extension 68 which, preferably, is constructed of copper is rigidly attached to second stage lead 80 by a conventional soldered joint (not shown). Lead 80, preferably, is constructed of any suitable flexible copper laminate. Lead 80 is rigidly attached to thermal extension 72 by a conventional soldered joint (not shown). Extension 72, preferably, is constructed of any suitable flexible copper laminate. Extension 72 is thermally connected to thermal station 10 by thermal contacts 74.

Thermal contacts 74 are constructed of the same material as thermal contacts 58. Finally, thermal station 10 is rigidly attached to superconductive winding 6 (FIG. 2) by conventional fasteners 82.

During the operation of current lead assembly 2, the first stage lead 54 operates from ambient temperature to the temperature of the thermal shield 8 and second stage lead 66 operates from the temperature thermal shield 8 to that of superconductive winding 6. Current leads 54 and 66 are cooled by direct thermal conduction to superconducting winding 6 and heat station 18.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A current lead assembly for a superconducting magnet, said assembly comprised of:

a superconducting magnet having a thermal shield means and a heat station means;

an ambient temperature interface means;

a first stage current lead means operatively connected to said thermal shield means and said ambient temperature interface means;

a second stage current lead means operatively connected to said thermal shield means and said magnet and a first stage lead extension means engaging said second stage lead.

2. The assembly, as in claim 1, wherein said first stage means is further comprised of:

a first lead means;

a first thermal contact means operatively connected to said first lead means; and a first thermal extension means operatively connected to said thermal contact means.

3. The assembly, as in claim 2, wherein said first thermal contact means is further comprised of:

metallized beryllia.

4. The assembly, as in claim 2, wherein said first thermal contact means is further comprised of:

alumina ceramic.

5. The assembly, as in claim 2, wherein said first lead means and said first thermal extension are further comprised of:

a copper laminate.

6. The assembly, as in claim 1, wherein said second stage current lead means is further comprised of:

a second lead means;

a second thermal contact means; and a second thermal extension means.

7. The assembly, as in claim 6, wherein said second thermal contact means is further comprised of:

metallized beryllia.

8. The assembly, as in claim 6, wherein said second thermal contact means is further comprised of:

alumina ceramic.

9. The assembly, as in claim 6, wherein said second lead means and said first thermal extension are further comprised of:

a copper laminate.

10. The assembly, as in claim 6, wherein said second lead means is further comprised of:

a ceramic superconducting material.

* * * * *